US011358843B2

(12) United States Patent
Ekshinge et al.

(10) Patent No.: US 11,358,843 B2
(45) Date of Patent: Jun. 14, 2022

(54) RETRACTING CARRIAGE ATTACHMENT

(71) Applicant: Manitou Equipment America, LLC, West Bend, WI (US)

(72) Inventors: Amitkumar D. Ekshinge, West Bend, WI (US); Paul Gilbert, West Bend, WI (US); Steven Kiskunas, Belgium, WI (US)

(73) Assignee: Manitou Equipment America, LLC, West Bend, WI (US)

( * ) Notice: Subject to any disclaimer, the term of this patent is extended or adjusted under 35 U.S.C. 154(b) by 0 days.

(21) Appl. No.: 16/863,274

(22) Filed: Apr. 30, 2020

(65) Prior Publication Data

US 2020/0369498 A1 Nov. 26, 2020

Related U.S. Application Data

(60) Provisional application No. 62/850,161, filed on May 20, 2019.

(51) Int. Cl.

| | |
|---|---|
| ***B66F 9/19*** | (2006.01) |
| ***B66F 9/065*** | (2006.01) |
| ***B66F 9/075*** | (2006.01) |
| ***B66F 17/00*** | (2006.01) |
| ***B66F 9/12*** | (2006.01) |

(52) U.S. Cl.

CPC ..... *B66F 9/0655* (2013.01); *B66F 9/0755* (2013.01); *B66F 9/122* (2013.01); *B66F 9/125* (2013.01); *B66F 17/003* (2013.01)

(58) Field of Classification Search

None

See application file for complete search history.

(56) References Cited

U.S. PATENT DOCUMENTS 2,993,610 A * 7/1961 Kughler ..... B66F 9/195 414/661

3,885,692 A 5/1975 Anderson et al.

(Continued)

FOREIGN PATENT DOCUMENTS

JP 2005-082290 3/2005

JP 2005082290 A * 3/2005

OTHER PUBLICATIONS

International Search Report and Written Opinion for International Application No. PCT/US2020/033594, dated Sep. 1, 2020, 12 pages.

*Primary Examiner* — Gerald McClain

(74) *Attorney, Agent, or Firm* — Husch Blackwell LLP

(57) ABSTRACT

A retractable pallet fork carriage assembly is provided that enhances the safe operation of a lift vehicle, such as a loader or telehandler. A carriage assembly is coupled to a fork tyne assembly through scissor links that expand and retract the tynes relative to the carriage assembly. When the scissor links are closed, the fork tynes extend through the carriage assembly to receive a payload (e.g., a pallet). When an operator wants to remove the payload, the fork tynes retract while the payload is supported against the carriage assembly. In this way, the load remains in one stationary position while pallet fork tynes are retracted under the payload to release the payload. Various sensors generate and/or send signals to limit the operation of the boom lift, boom, and/or retractable attachment when a distance or load is out of a threshold range.

12 Claims, 9 Drawing Sheets

(56) References Cited

U.S. PATENT DOCUMENTS

| | | | | | |
|---|---|---|---|---|---|
| 4,284,384 | A * | 8/1981 | Olson | B66F 9/195 | 414/434 |
| 4,297,070 | A * | 10/1981 | Didtel | B66F 9/24 | 414/497 |
| 4,300,867 | A * | 11/1981 | Frees | B66F 9/195 | 414/493 |
| 4,708,575 | A * | 11/1987 | Farmer | B66F 9/195 | 414/497 |
| 4,775,288 | A | 10/1988 | Dimitriu | | |
| 4,832,562 | A * | 5/1989 | Johnson | B65D 19/00 | 180/125 |
| 4,861,223 | A * | 8/1989 | Olson | B66F 9/195 | 414/661 |
| 5,577,873 | A * | 11/1996 | Tanaka | B65G 67/20 | 414/280 |
| 10,793,407 | B1 * | 10/2020 | Hamlik | B66F 9/195 | |
| 2006/0171797 | A1 * | 8/2006 | Hedley | B66F 9/149 | 414/482 |
| 2013/0195592 | A1 * | 8/2013 | Meijer | B66F 9/195 | 414/661 |
| 2018/0120465 | A1 | 5/2018 | Rose et al. | | |

* cited by examiner

RETRACTING CARRIAGE ATTACHMENT

CROSS-REFERENCE TO RELATED PATENT APPLICATION

The present application claims the benefit of and priority to U.S. Provisional Application No. 62/850,161 filed on May 20, 2019, which is incorporated herein by reference in its entirety.

BACKGROUND OF THE INVENTION

The present invention relates generally to the field of lift vehicles, such as boom lifts and telehandlers. Operators employ many types of heavy equipment (loaders, articulated loaders, track loaders, skid steers, telehandlers, boom handlers, etc.) to accomplish a variety of tasks. Illustrative example uses include farming and construction. These vehicles operate a boom extension that extends or retracts the boom to lift or lower an object (e.g., a loaded pallet). A load carrier is used to support a load temporarily (e.g., a pallet). The present invention relates specifically to a carriage attachment on a lift vehicle.

SUMMARY OF THE INVENTION

One embodiment of the invention relates to a retractable lift attachment for a loader or a telehandler. The retractable lift attachment includes a load carrier, a frame, scissor links, and an expansion cylinder. The frame includes a backrest that is coupled to and surrounds an attachment plate. The load carrier extends through the backrest in an extended position, and the load carrier is retracted behind the backrest in a retracted position. Scissor links couple the load carrier to the frame. The expansion cylinder is coupled to the scissor links. The expansion cylinder closes the scissor links to extend the load carrier into the extended position. The expansion cylinder expands the scissor links to retract the load carrier from the frame in the retracted position.

Another embodiment of the invention relates to a retractable lift attachment for a loader or telehandler. The retractable lift attachment includes pallet fork tynes, a carriage assembly, a four-bar linkage, and an expansion cylinder. The pallet fork tynes extend along a longitudinal axis. The carriage assembly includes a planar backrest that is perpendicular to the longitudinal axis of the pallet fork tynes and is coupled to and surrounds a hoist bridle. The carriage assembly surrounds the hoist bridle and the pallet fork tynes in a first extended position. The pallet fork tynes are retracted behind the carriage assembly in a second retracted position. The four-bar linkage couples the pallet fork tynes to the carriage assembly. The expansion cylinder is coupled to the four-bar linkage. The expansion cylinder closes the four-bar linkage to extend the pallet fork tynes through the carriage assembly in the first extended position. The expansion cylinder opens the four-bar linkage to retract the pallet fork tynes from the carriage assembly in the second retracted position.

Another embodiment of the invention relates to a lift vehicle, such as a loader or telehandler. The lift vehicle includes a chassis, a boom, a goose-neck, and a retractable attachment. The chassis includes a cab. The boom extends and retracts axially. The goose-neck is coupled to the boom and defines a longitudinal extending axially through the goose-neck. The retractable attachment includes a load carriage, a carriage assembly, a plurality of scissor links, and an expansion cylinder. The carriage assembly includes a hoist bridle that interconnects the goose-neck to a backrest that surrounds the hoist bridle. The plurality of scissor links interconnects the load carrier to the carriage assembly. The expansion cylinder is coupled to the plurality of scissor links and expands or retracts the load carrier relative to the carriage assembly.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
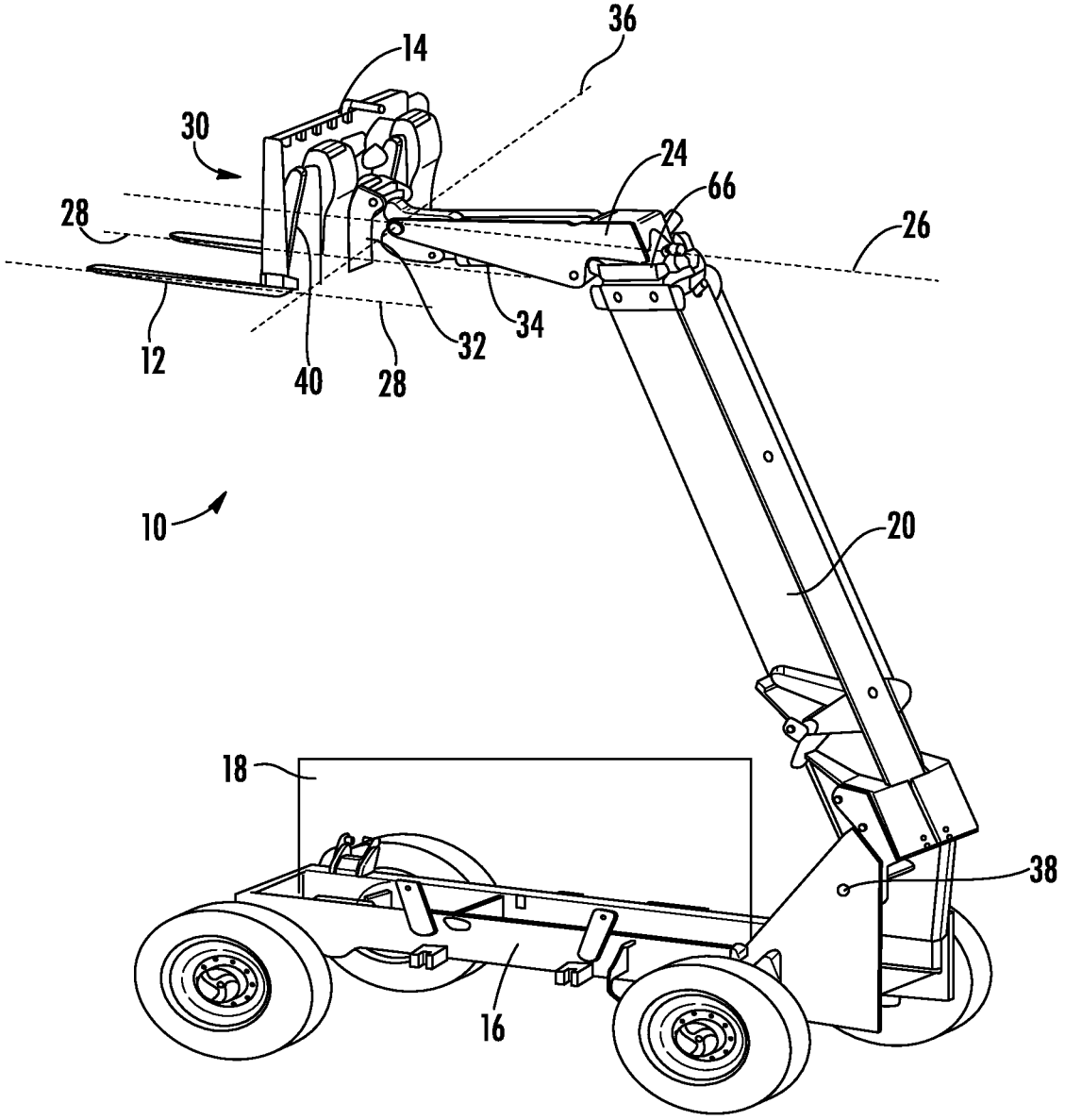
FIG. 1 is a perspective view of a boom lift with fork tynes extended relative to a carriage assembly of a retractable attachment, according to an exemplary embodiment.
Figure 2:
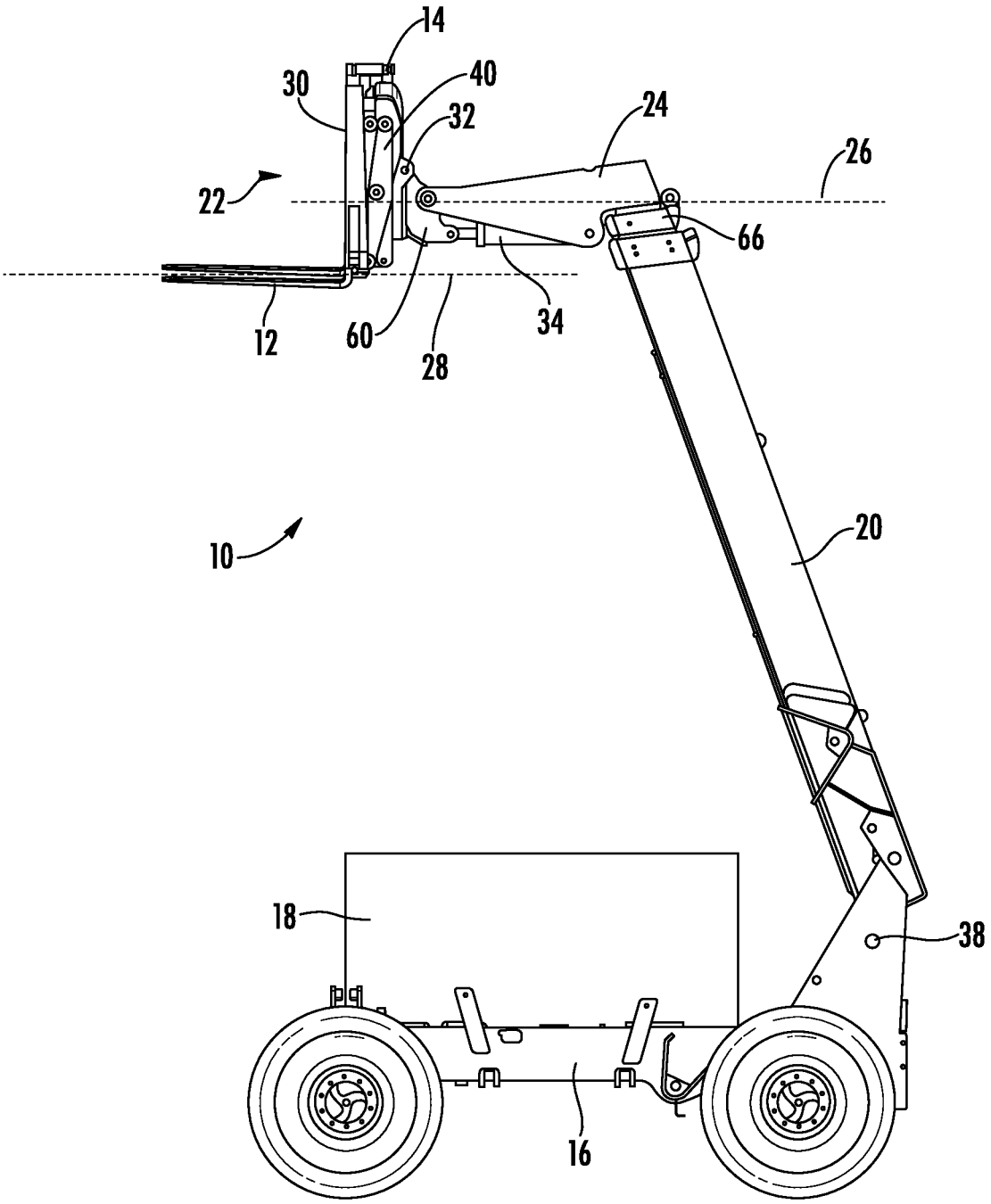
FIG. 2 is a side view of the boom lift with fork tynes extended relative to the carriage assembly of the retractable attachment, according to an exemplary embodiment.

Referring to FIGS. 1 and 2, these figures illustrate a perspective and side view of a boom lift or lift vehicle 10. As shown in FIGS. 1 and 2, lift vehicle 10 includes extended fork tynes 12 extending relative to a frame or carriage assembly 14. Lift vehicle 10 includes a chassis 16 and a cab 18. Boom 20 extends and retracts axially to lift a retractable attachment 22. A goose-neck 24 is coupled to boom 20 and defines a goose-neck longitudinal axis 26 that extends axially through goose-neck 24. Commercial examples of such lift vehicles are telehandlers, loaders, articulated loaders, skid loaders, track loaders, and other products.

Retractable attachment 22 includes a load carrier, such as pallet fork tynes 12. The load carrier may include a cage, a drum or barrel lift, load push units, bale clamps, pole tine clamps, box discharge units, rotator assemblies, attachment clamps, harbor clamps, appliance clamps, a deck, shovels, clamps for cement pipes, fork clamps, push-pulls, load stabilizers, personal basket, multi-pallet handler, pipe clamps, timber grippers, snow scoop, scoops, clamps, telescopic forks, carpet boom, load extenders, and/or fork positioners. For convenience only, this application refers to load carriers generally as pallet fork tynes 12, but retractable attachments may include a variety of load carriers configured for a particular construction, agricultural task, or another task.

Figure 8:
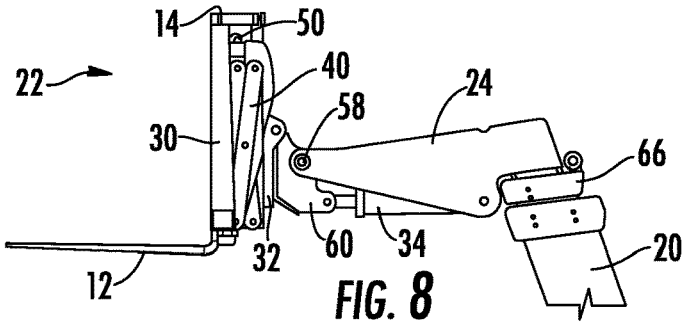
FIG. 8 is a side view of the retractable attachment with fork tynes fully extended relative to the carriage assembly; the retractable attachment is coupled to the telehandler boom.
Figure 9:
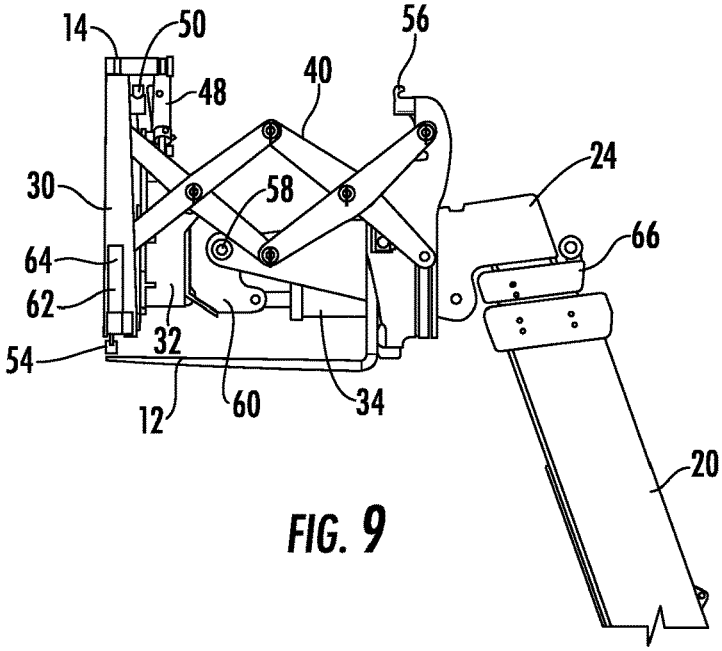
FIG. 9 is a side view of the retractable attachment with fully retracted fork tynes fully retracted relative to the carriage assembly; the retractable attachment is coupled to the telehandler boom.

Pallet fork tynes 12 include respective fork-tyne longitudinal axes 28. Carriage assembly 14 includes a generally planar load backrest 30 that is perpendicular to fork-tyne longitudinal axes 28. Load backrest 30 may be non-planar; for example, load backrest 30 may be convex or concave for a particular application. Carriage assembly 14 is coupled to and surrounds a hoist bridle 32 (best shown in FIGS. 3-5). Carriage assembly 14 surrounds pallet fork tynes 12 in a first or extended position (FIG. 8). Pallet fork tynes 12 can be retracted behind carriage assembly 14 in a second or retracted position (FIG. 9).

Lift vehicle 10 may include a tilt cylinder 34 that rotates retractable attachment 22 (e.g., tynes 12 and/or carriage assembly 14) about a goose-neck transverse axis 36 (e.g., transverse pin 58) that is perpendicular to the goose-neck longitudinal axis 26. Boom 20 can rotate about a pivot axis 38 on chassis 16.

Figure 3:
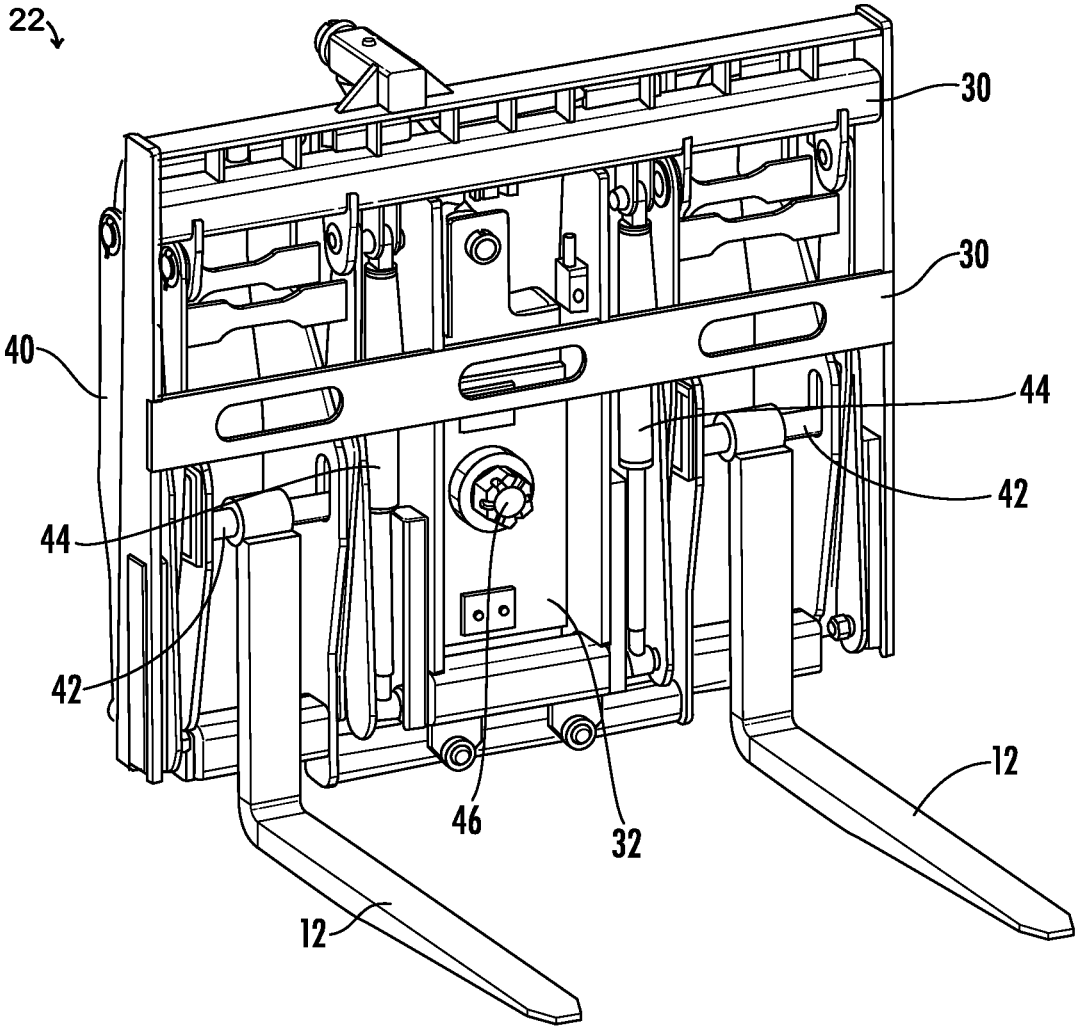
FIG. 3 is a front isometric view of the retractable attachment, including the carriage assembly, a load backrest, and fork tynes, according to an exemplary embodiment.

FIG. 3 is a front isometric view of the retractable attachment 22, including a load backrest 30 and fork tynes 12. Carriage assembly 14 includes an attachment plate or hoist bridle 32 that interconnects goose-neck 24 to backrest 30. Backrest 30 surrounds hoist bridle 32. A plurality of scissor links 40 interconnect the pallet fork tynes 12 to carriage assembly 14. Scissor links 40 define or form a four-bar linkage.

As shown in FIG. 3, one or more expansion cylinders 44 couple to scissor links 40. Expansion cylinders 44 may include hydraulic cylinders or electrical cylinder actuators. As illustrated, expansion cylinders 44 couple to the ends of scissor links 40. In this configuration, expansion cylinders 44 lengthen to close scissor links 40. The lengthened scissor links 40 reduces the distance in the direction of longitudinal axis 26 and extends pallet fork tynes 12 through carriage assembly 14. In other words, in the first or extended position (FIG. 8), expansion cylinders 44 expand to close (shorten) scissor links 40 and pallet fork tynes 12 extend through carriage assembly 14. In the second or retracted position (FIG. 9), expansion cylinders 44 close to open (lengthen) scissor links 40, which retracts pallet fork tynes 12 from carriage assembly 14. This provides added load stability when disengaging a load from tynes 12. This added stability is provided by maintaining the load backrest 30 stationary relative to (i.e., against) a load while the tynes 12 are slid from under the load. Other connections of expansion cylinders 44 to scissor links 40 are contemplated. Retracting fork tynes 12 result in "pulling" tynes 12 from under a supported load rather than "pushing" a load off tynes 12 with carriage assembly 14.

FIG. 3 provides a front perspective view of rotator pivot pin 46. Rotator pivot pin 46 provides support to rotate pallet fork-tynes 12 and/or carriage assembly 14 of the retractable attachment 22 about hoist bridle 32. For example, the retractable attachment 22 is coupled to hoist bridle 32 and rotates in a clockwise or counter-clockwise direction about rotator pivot pin 46 (e.g., collinear and/or coaxial with the goose-neck longitudinal axis 26).

Figure 4:
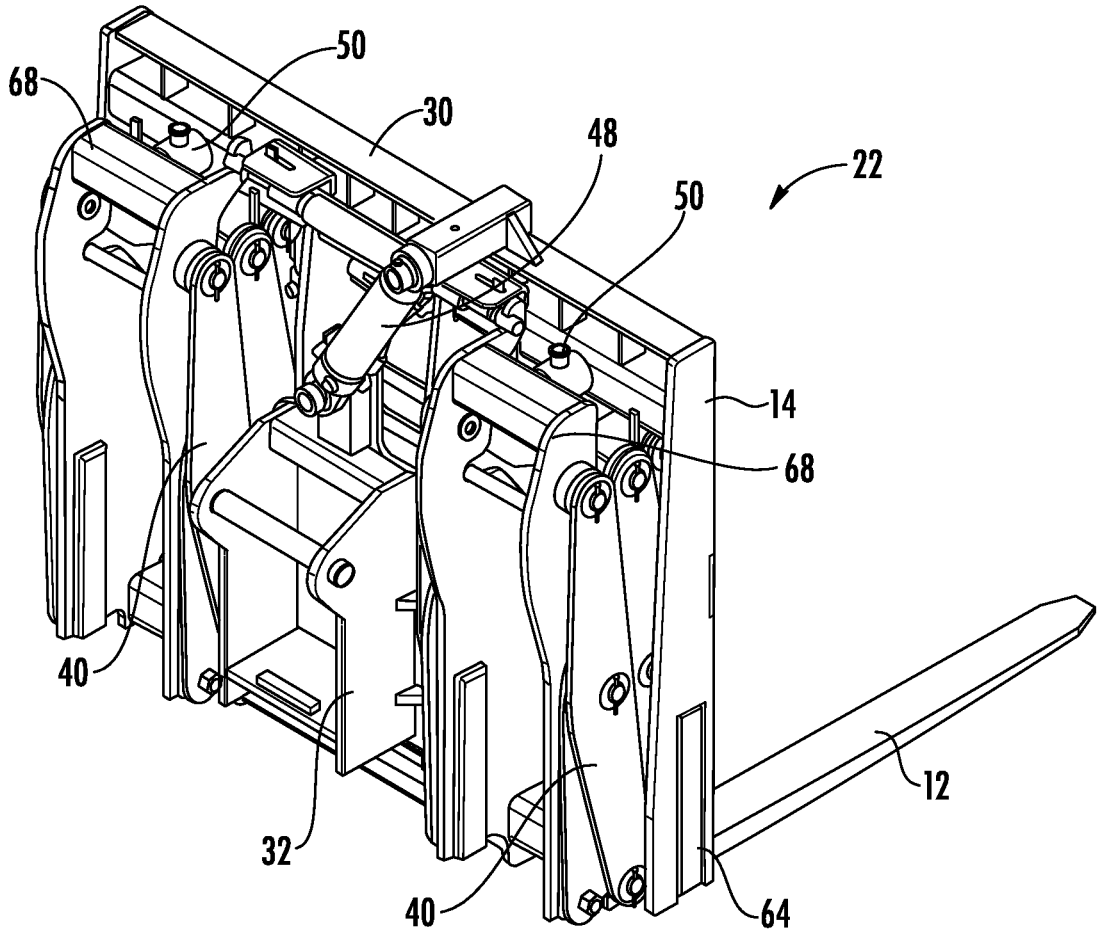
FIG. 4 is a rear isometric view of the retractable attachment, including the carriage assembly and pallet fork tynes of FIG. 3.
Figure 5:
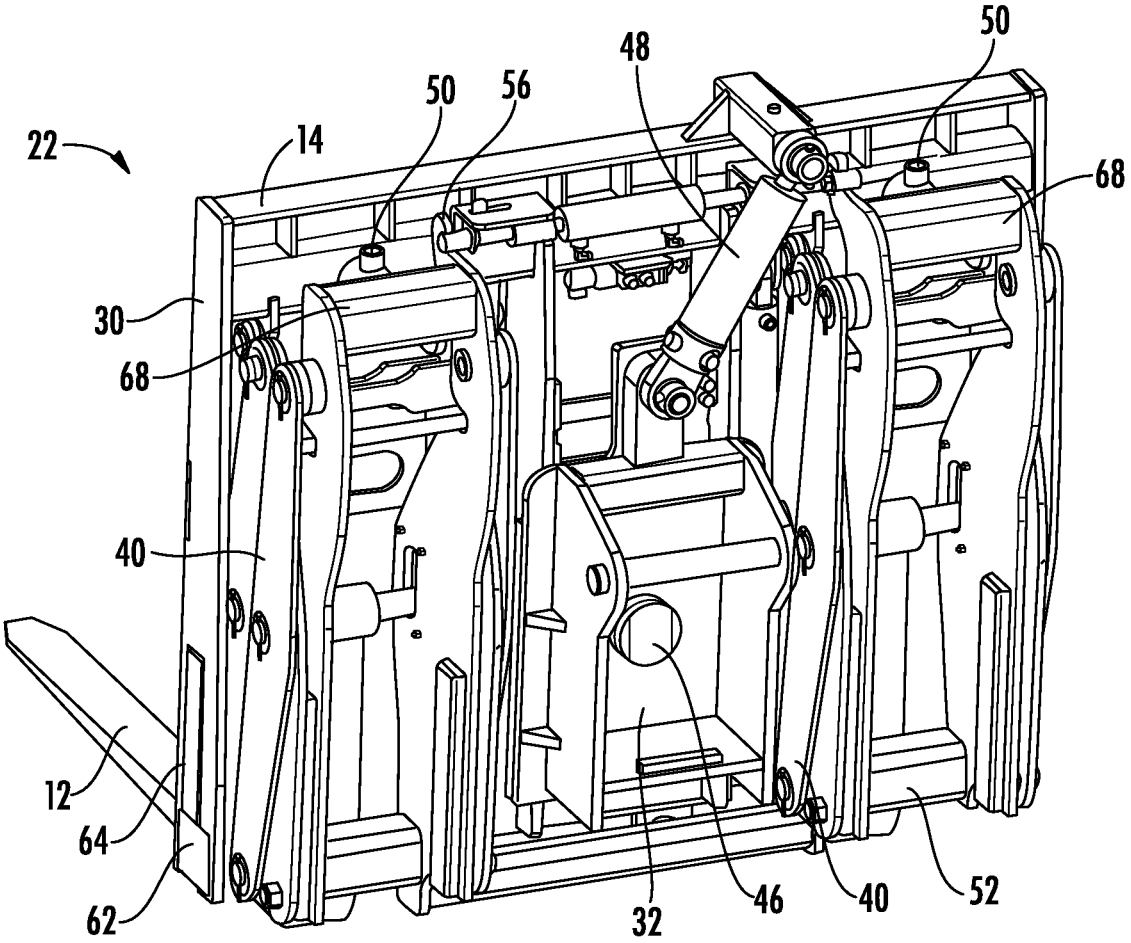
FIG. 5 is a different rear isometric view of the retractable attachment, including the carriage assembly and pallet fork tynes of FIGS. 3 and 4.

FIGS. 4 and 5 are rear isometric views from different perspectives of the retractable attachment 22 and load backrest 30. As shown from this perspective, carriage assembly 14 includes and/or couples to hoist bridle 32 that interconnects goose-neck 24 to carriage assembly 14 and/or load backrest 30.

As described above, retractable attachment 22 rotates about rotator pivot pin 46 (FIG. 3). A rotary cylinder 48 couples the carriage assembly to hoist bridle 32 and provides a force that rotates retractable attachment 22 about pivot pin 46. For example, an axial direction of rotator pivot pin 46 provides an axis of rotation that also couples retractable attachment 22 to goose-neck 24. The axis of rotation or rotator pivot pin 46 may be parallel, collinear, and/or coaxial with the longitudinal axes 26 (FIGS. 1 and 2).

A displacement or proximity sensor 50 generates a proximity distance signal indicative of a distance between pallet fork tynes 12 and carriage assembly 14. One or more load sensors 52 generate a signal indicative of a load on pallet fork tynes 12. The distance signal and/or load signal can prevent the operation of various components of lift vehicle 10 (e.g., boom 20 and/or retractable attachment 22) when a distance between pallet fork tynes 12 relative to carriage assembly 14 exceeds a predetermined threshold. Lift vehicle 10 may also include a position sensor 54 (FIGS. 9 and 11) that generates a position signal indicative of a position of pallet fork tynes 12 to an external supporting surface, such as a scaffolding surface, shelf or the ground. In this way, signals generated by the proximity sensor 50, the load sensor 52, and/or the position sensor 54 can prevent operation of lift vehicle 10, boom 20, and/or retractable attachment 22 when a signal generated by one or more sensor(s) 50, 52, and/or 54 exceeds a threshold value (e.g., load, proximity, and/or distance thresholds).

Proximity sensor 50 generates a signal that prevents operation of lift vehicle 10, boom 20, and/or retractable attachment 22 when a lock 56 securing pallet fork tynes 12 to carriage assembly 14 is disengaged. Load sensor 52 generates a signal that prevents retraction of pallet fork tynes 12 from the extended position to the retracted position when the load on tynes 12 exceeds a threshold load value. Position sensor 54 generates a signal that prevents retraction of pallet fork tynes 12 when the fork tynes 12 are located at a distance from a support structure (e.g., a shelf or ground) that exceeds a distance threshold.

Figure 6:
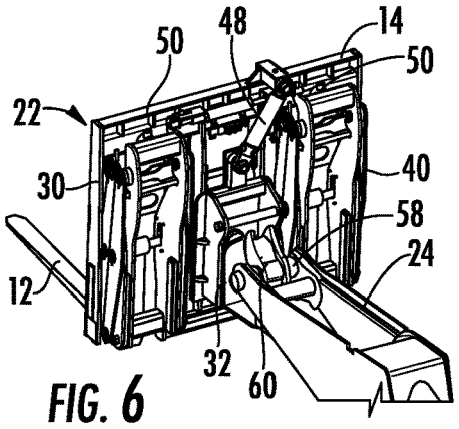
FIG. 6 is a rear isometric view of the retractable attachment of FIGS. 3, 4, and 5 coupled to a telehandler boom, according to an exemplary embodiment.
Figure 7:
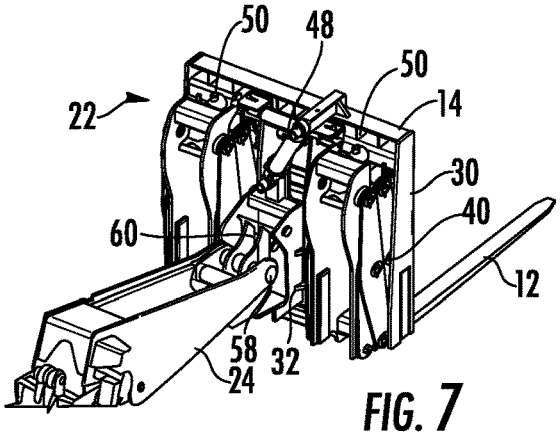
FIG. 7 is a different rear isometric view of the retractable attachment coupled to the telehandler boom, as shown in FIG. 6.

FIGS. 6 and 7 are rear isometric views of retractable attachment 22 of FIGS. 3, 4, and 5 coupled to boom 20 and/or goose-neck 24 of a boom lift, telehandler, loader, or another lift vehicle 10. These rear views show a transverse pin 58 that couples a knuckle 60 to hoist bridle 32. In this way, retractable attachment 22 can rotate about transverse pin 58 that is parallel, coaxial, and/or collinear with transverse axis 36. FIGS. 6 and 7 illustrate how retractable attachment 22 of FIGS. 4 and 5 couples to boom 20 and/or goose-neck 24.

FIG. 8 is a side view of retractable attachment 22 in a first or extended position. As shown, fork tynes 12 are fully extended through carriage assembly 14 and load backrest 30. Retractable attachment 22 is coupled to goose-neck 24 and/or boom 20 of lift vehicle 10. In this configuration, expansion cylinders 44 are lengthened to close scissor links 40, and the retractable attachment 22 has fork tynes 12 extended through carriage assembly 14.

In contrast to FIG. 8, FIG. 9 is a side view of retractable attachment 22 in a second or retracted position. Expansion cylinders 44 are shortened to open scissor links 40, so that fork tynes 12 are fully retracted away from carriage assembly 14 and load backrest 30. Retractable attachment 22 is coupled to goose-neck 24 and/or boom 20 of lift vehicle 10. Carriage assembly 22 may include guide rails 62 and/or rollers 64 that direct the extension and/or retraction of pallet fork tynes 12.

FIGS. 8 and 9 also show an internal boom 66. Internal boom 66 is slidably coupled with boom 20 to extend along a longitudinal axis of boom 20. Lift vehicle 10 has 1, 2, 3, 4, or more internal booms that extend to lift retractable attachment 22. Position sensor 54 generates a position signal indicative of a position of at least one of fork tynes 12 and/or carriage assembly 14 with respect to an external surface such as ground.

Figure 10:
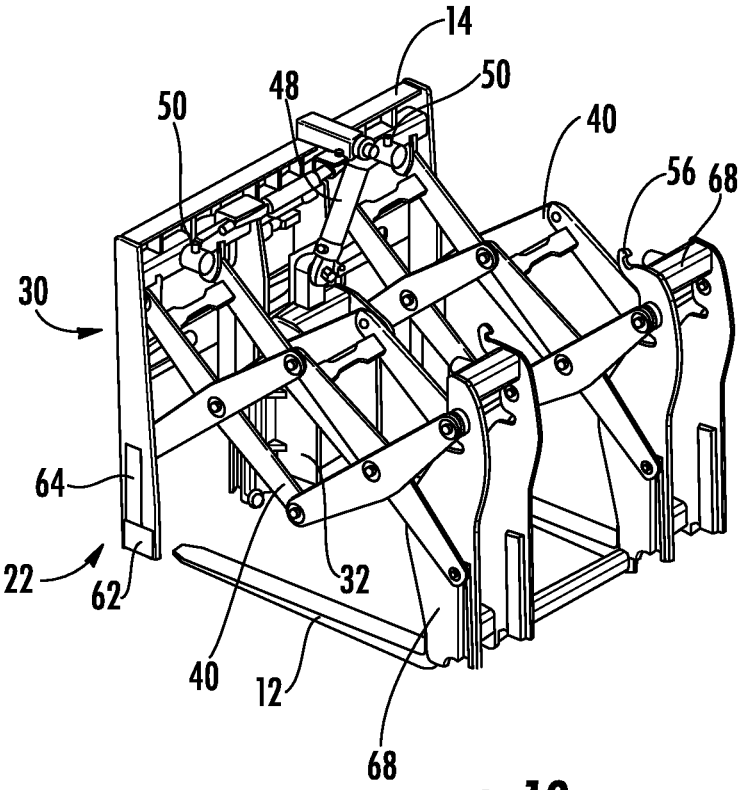
FIG. 10 is a rear isometric view of the retractable attachment, including the fork tynes and carriage assembly, where the fork tynes are fully retracted relative to the carriage assembly.
Figure 11:
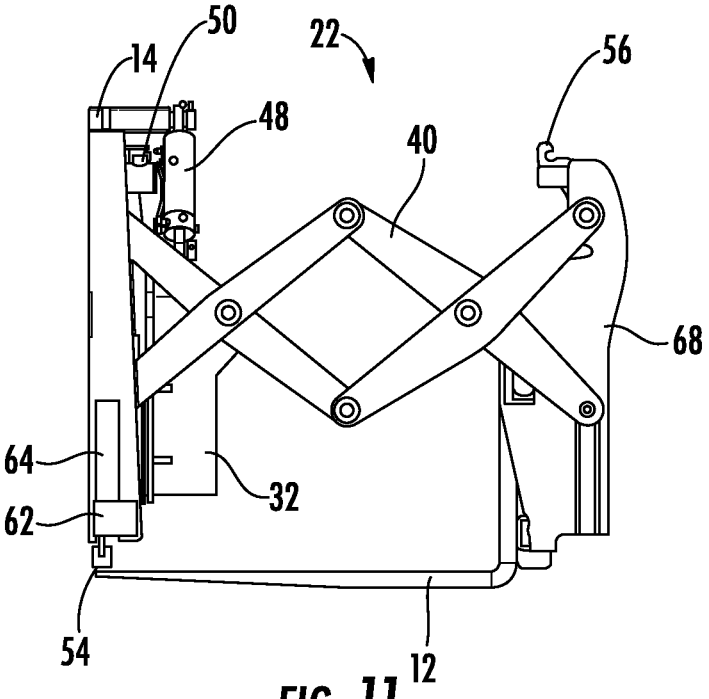
FIG. 11 is a side view of the retractable attachment, including the fork tynes and the carriage assembly, where the fork tynes are fully retracted relative to the carriage assembly.

FIGS. 10 and 11 are different views of retractable attachment 22. Retractable attachment 22 includes fork tynes 12, carriage assembly 14, and/or load backrest 30. In the configuration shown in FIGS. 10 and 11, fork tynes 12 are in a fully retracted position. As shown in the retracted position of FIGS. 10 and 11, fork tynes 12 are retracted behind carriage assembly 14 and load backrest 30. Goose neck 24 (FIGS. 1 and 2) extends between two fork carriers 68 to couple with hoist bridle 32 on backrest 30.

As shown in FIGS. 10 and 11, two fork carriers 68 couple to and support two pallet fork tynes 12. As shown, two sets of scissor links 40 couple each fork carrier 68 to carriage assembly 14. In addition, two expansion cylinders 44 couple each fork carrier 68 to carriage assembly 14. For example, each expansion cylinder 44 couples to at least one scissor link 44 associated with each fork carrier 68.

FIG. 11 further illustrates position sensor 54 and lock 56 that couples to proximity sensor 50. Lock 56 secures fork carriers 68 to carriage assembly 14. As illustrated, fork carriers 68 are coupled to pallet fork tynes 12. The locks 56 may include a displacement or proximity sensor 50 that generates a distance signal indicative of the proximity between carriage assembly 14 and fork carriers 68. The signal can further indicate whether carriage assembly 14 is securely locked to fork carriers 68 (e.g., as shown in FIG. 8). For example, lock 56 is disposed on fork carrier 68 and/or load backrest 30 and secures load carrier 68 to carriage assembly 14 when load carrier 68 extends pallet fork tynes 12 through carriage assembly 14 in the first or extended position.

Figure 12:
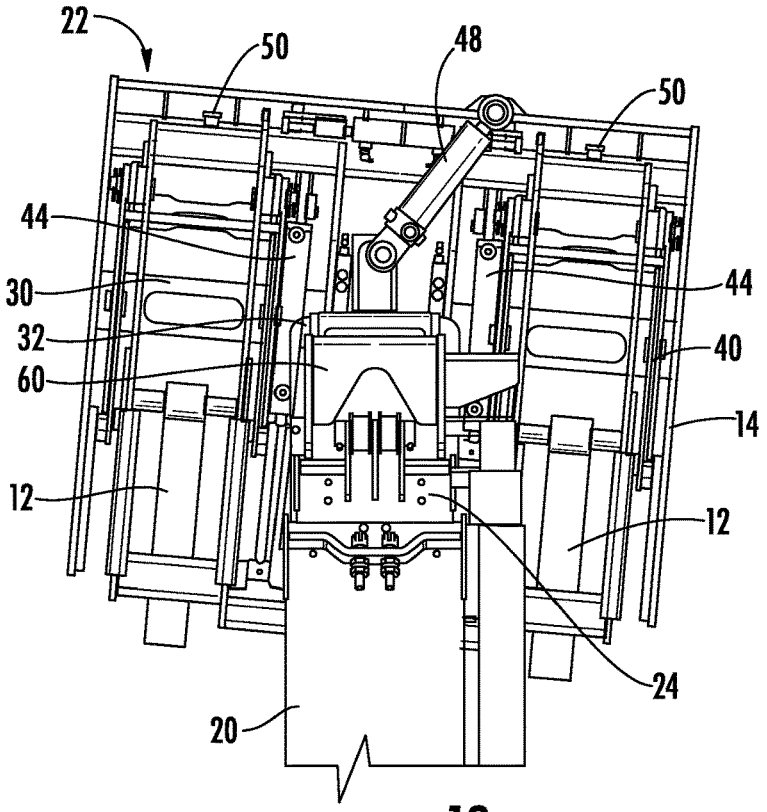
FIG. 12 is a rear view of a retractable attachment along the longitudinal axis of the goose-neck and illustrating the carriage assembly rotated clockwise 5-10 degrees in this view, according to an exemplary embodiment.
Figure 13:
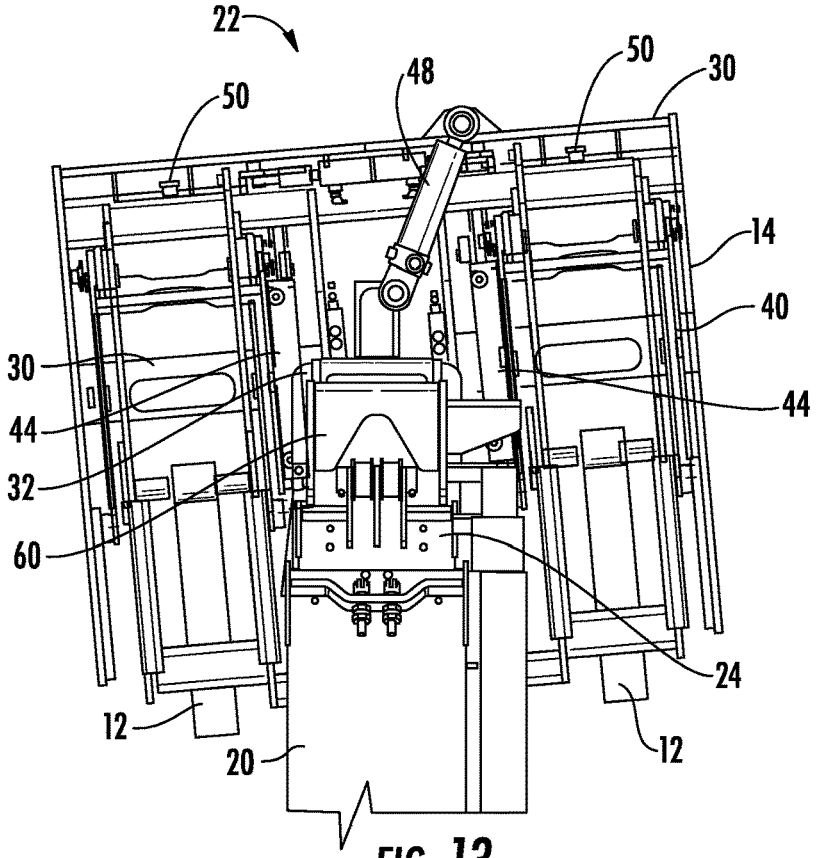
FIG. 13 is a rear view of a retractable attachment along the longitudinal axis of the goose-neck and illustrating the carriage assembly rotated counter-clockwise 5-10 degrees in this view, according to an exemplary embodiment.

FIGS. 12 and 13 show retractable attachment 22 from a rear perspective along the goose-neck longitudinal axis 26. This perspective illustrates retractable attachment 22 rotated 5 to 10 degrees clockwise in FIG. 12 and rotated 5 to 10 degrees counter-clockwise in FIG. 13 from this rear perspective. Referring to FIG. 12, rotary cylinder 48 is lengthened to push carriage assembly 14 away from hoist bridal 32 and rotate retractable attachment 22 in a clockwise direction, as viewed from behind along the goose-neck longitudinal axis 26 (FIG. 1). In contrast, FIG. 13 shows rotary cylinder 48 in a shortened position to pull carriage assembly 14 towards hoist bridal 32 and rotate retractable attachment 22 in a counter-clockwise direction.

Figure 15:
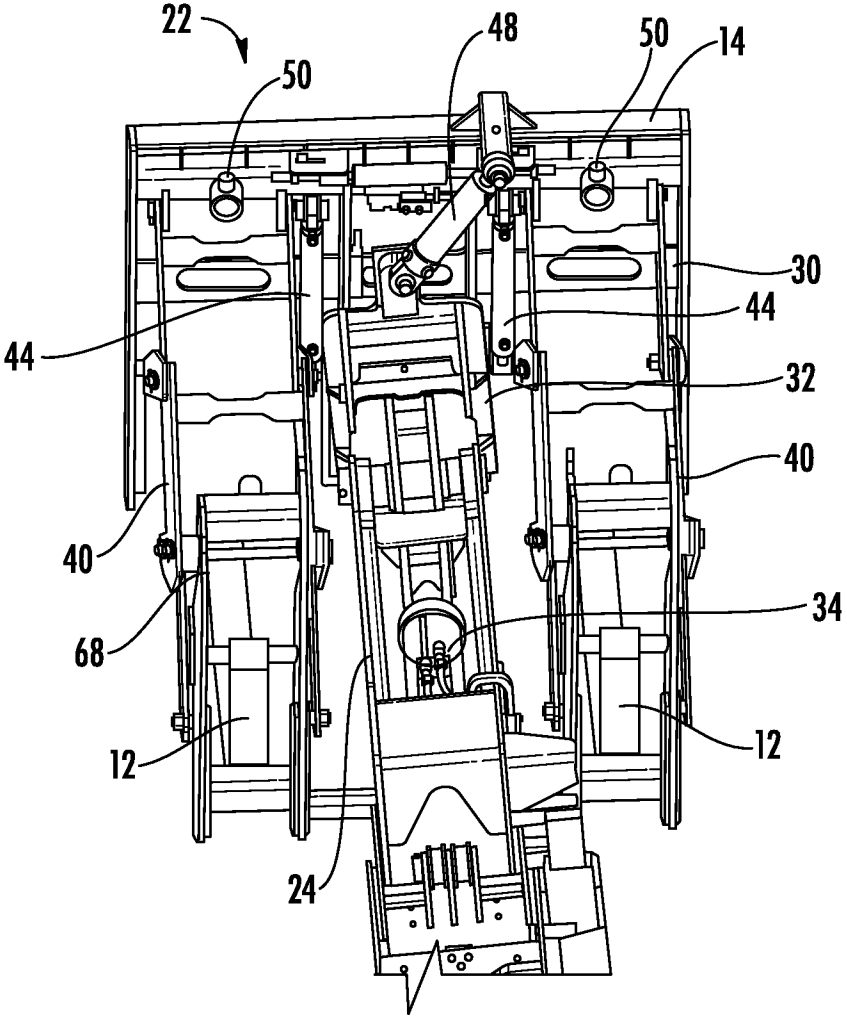
FIG. 15 is a rear perspective view from above the carriage assembly of FIG. 13, where the carriage assembly is rotated counter-clockwise 5-10 degrees, and the fork tynes are in the retracted position.
Figure 14:
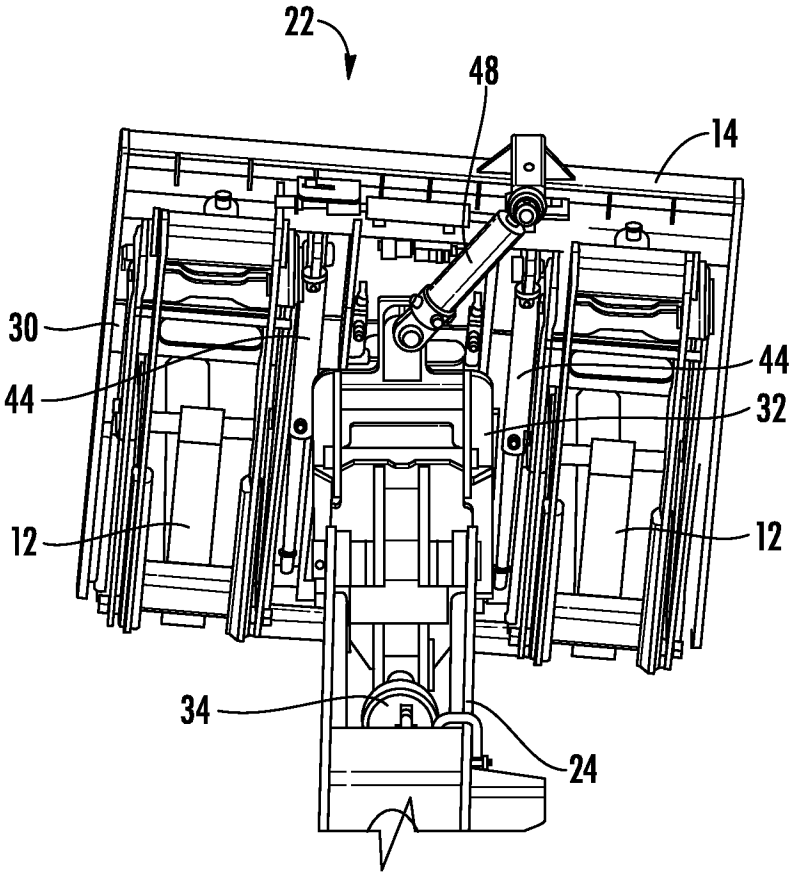
FIG. 14 is a rear perspective view from above the carriage assembly of FIG. 12 and rotated clockwise 5-10 degrees.

FIGS. 14 and 15 show top perspective views of retractable attachment 22. As shown, retractable attachment 22 is rotated clockwise (FIG. 14) and counter-clockwise (FIG. 15). In various embodiments, retractable attachment 22 rotates between 3 and 10 degrees, specifically, between 4 and 8 degrees, and more specifically between 5 and 7 degrees. FIG. 14 is a top perspective view of FIG. 12 where retractable attachment 22 is rotated in a clockwise (CW) direction. FIG. 15 is similar to FIG. 13 in that both show the retractable attachment 22 in a counter-clockwise (CCW) rotation, but FIG. 15 shows retractable attachment 22 is in a retracted and rotated position. In various embodiments, pallet fork tynes 12 retract from carriage assembly when the retractable attachment 22 is rotated at any position between 10 degrees CW to 10 degrees CCW, specifically between 7 degrees CW to 7 degrees CCW, and more specifically between 5 degrees CW and 5 degrees CCW.

Retractable attachment 22 rotates to provide access for different surfaces, angles, and slopes. For example, lift vehicle 10 may operate on an incline. Retractable attachment 22 rotates about pivot pin 46 (FIGS. 3 and 5) to place the pallet or payload on a level or flat surface. In other situations, retractable attachment 22 may need to rotate to access or reach into an external environment, such as the back of a truck, a narrow shelf, or other structure. Retractable attachment 22 enhances the safe operation of lift vehicle 10 by limiting the distance and load thresholds to deliver the payload. For example, limiting the operation of lift vehicle 10, boom 20, and/or retractable attachment 22 reduces the risk of an operator inadvertently unloading a payload by, for example, retracting fork tynes 12 through carriage assembly 14.

Retracting fork tynes 12 through carriage assembly may also use a load sensor to determine when expansion cylinder 44 is deployed to retract fork tynes 12. For example, if the load sensed on fork tynes 12 is above a threshold value, a signal may prevent expansion cylinders 44 from operating to retract fork tynes, further improving operational safety. The load sensor and/or distance sensor reduces the ability of an operator to drop a payload (e.g., greater than 3", 6", 9", or 12"). Further, retractable attachment 22 facilitates secure unloading a payload without moving the payload. For example, the payload is secured against load backrest 30 and remains stationary while fork tynes 12 retract under the payload.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions, and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths, and radii, as shown in the Figures are to scale. Actual measurements of the Figures will disclose relative dimensions, angles, and proportions of the various exemplary embodiments. Various exemplary embodiments extend to various ranges around the absolute and relative dimensions, angles, and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A retractable lift attachment, comprising:

pallet fork tines extending along a longitudinal axis;

a carriage assembly comprising a planar backrest that is perpendicular to the longitudinal axis of the pallet fork tines, wherein the carriage assembly is coupled to and surrounds a hoist bridle;

a four-bar linkage coupling the pallet fork tines to the carriage assembly and configured to move the pallet fork tines relative to the hoist bridle between a first extended position and a second retracted position while maintaining the planar backrest in a stable position relative to the hoist bridle; and an expansion cylinder coupled to the four-bar linkage, wherein the expansion cylinder closes the four-bar linkage to extend the pallet fork tines through the carriage assembly in the first extended position and opens the four-bar linkage to retract the pallet fork tines from the carriage assembly in the second retracted position.

2. A lift vehicle, comprising:

a chassis comprising a cab;

a boom configured to extend and retract axially;

a goose-neck coupled to the boom and defining a longitudinal axis extending axially through the goose-neck; and a retractable attachment, comprising:

a load carrier;

a carriage assembly comprising a hoist bridle that interconnects the goose neck to a backrest that surrounds the hoist bridle;

a plurality of scissor links interconnecting the load carrier to the carriage assembly and configured to move the load carrier relative to the hoist bridle between a first extended position and a second retracted position while maintaining the backrest in a stationary position relative to the hoist bridle; and an expansion cylinder coupled to the plurality of scissor links, wherein the expansion cylinder closes the plurality of scissor links to extend pallet fork tines through the carriage assembly in the first extended position and opens the scissor links to retract the pallet fork tines from the carriage assembly in the second retracted position.

3. The lift vehicle of claim 2, further comprising proximity sensors that generate a distance signal indicative of a position of the load carrier relative to the carriage assembly and load sensors that generate a load signal indicative of a load on the load carrier, wherein operation of the lift vehicle is prevented when the distance signal exceeds a threshold.

4. The lift vehicle of claim 2, further comprising a position sensor that generates a displacement signal indicative of a position of the load carrier to an external supporting surface and a load sensor that generates a load signal indicative of a load on the load carrier, wherein the load signal and displacement signal prevent operation of the retractable attachment when the displacement signal exceeds a threshold distance.

5. The lift vehicle of claim 2, further comprising a rotary cylinder that interconnects the carriage assembly to the goose-neck, the rotary cylinder configured to rotate the carriage assembly and the load carrier about the longitudinal axis of the goose-neck.

6. The lift vehicle of claim 2, further comprising a tilt cylinder configured to rotate the carriage assembly and the load carrier about a transverse axis that is perpendicular to the longitudinal axis.

7. The lift vehicle of claim 2, wherein the boom is rotatable about a chassis pivot axis.

8. A retractable lift attachment comprising:

pallet fork tines extending along a longitudinal axis;

a carriage assembly comprising a planar backrest that is perpendicular to the longitudinal axis of the pallet fork tines and is coupled to and surrounds a hoist bridle, the carriage assembly surrounding the hoist bridle and the pallet fork tines in a first extended position, and the pallet fork tines being retracted behind the carriage assembly in a second retracted position;

one or more four-bar linkages coupling the pallet fork tines to the carriage assembly;

one or more expansion cylinders coupled to the one or more four-bar linkages, wherein the expansion cylinders retract to close the four-bar linkages and extend the pallet fork tines through the carriage assembly in the first extended position, the expansion cylinders expand to open the four-bar linkages and retract the pallet fork tines from the carriage assembly in the second retracted position; and a lock that secures the carriage assembly to fork carriers coupled to the pallet fork tines, the locks comprising a proximity sensor that generates a distance signal indicative of a distance between the carriage assembly and the fork carriers, the distance signal further indicating whether the carriage assembly is securely locked to the fork carriers.

9. The retractable lift attachment of claim 8, further comprising a rotary cylinder that rotates the carriage assembly and the pallet fork tines about an axis of the hoist bridle.

10. The retractable lift attachment of claim 8, wherein the one or more four bar linkage includes two sets of four-bar linkages that couple each fork carrier to the carriage assembly.

11. The retractable lift attachment of claim 10, wherein the one or more expansion cylinders include two expansion cylinders coupled to at least one of the sets of four-bar linkages associated with each fork carrier.

12. The retractable lift attachment of claim 8, further comprising a load sensor that generates a load signal indicative of a load on the pallet fork tines, wherein extraction of the one or more expansion cylinders is prevented when the load signal is above a threshold.

* * * * *